United States Patent [19]

Fahlström et al.

[11] 3,942,727

[45] Mar. 9, 1976

[54] GRINDING PLANT

[75] Inventors: Per Anders Herman Henningsson Fahlström, Akers Runo; Erik Alfon Jonsson, Boliden, both of Sweden

[73] Assignee: Boliden Aktiebolag, Stockholm, Sweden

[22] Filed: Apr. 8, 1974

[21] Appl. No.: 459,043

[30] Foreign Application Priority Data

Apr. 13, 1973 Sweden ..... 7305265

[52] U.S. Cl. ..... 241/34; 241/80

[51] Int. Cl.[2] ..... B02C 25/00

[58] Field of Search ..... 241/34, 76, 78, 80, 153, 241/161

[56] References Cited

UNITED STATES PATENTS

| | | | |
|---|---|---|---|
| 2,398,989 | 4/1946 | Agthe | 241/80 X |
| 2,965,316 | 12/1960 | Henderson et al. | 241/34 |
| 2,980,347 | 4/1961 | Claes | 241/34 |
| 3,078,050 | 2/1963 | Hardinge | 241/34 X |

*Primary Examiner*—Granville Y. Custer, Jr.
*Attorney, Agent, or Firm*—Stevens, Davis, Miller & Mosher

[57] ABSTRACT

A grinding plant for autogenous or semi-autogenous grinding of ores in particular, in separate mills in two steps. The second step uses material from the first step, which is provided with two outlets. The first outlet has holes for discharging relatively finely ground material to be further ground in the second step, and the second outlet has holes for discharging material containing relatively coarse pieces forming grinding media in the second step. A device is provided between the stages to control the flow of coarser material to the second step. Connected to the discharge side of the second step, which is provided with outlet holes as large as the holes for fine material in the first step, there is a means to separate material removed from the second step into a finely ground portion, which is led away, and a portion returned to the first and second steps in proportions adjustable by said means.

9 Claims, 5 Drawing Figures

10
11
12
13
14
15
16
17
18
19
20
21
22
23
24
25
26
27
28
29
30
31
32
33
34
35
36
37
38
62
74
75
76
77
78
79
80
81

GRINDING PLANT

The present invention relates to a plant for the autogeneous or semi-autogeneous grinding of material, particularly ore, in at least two separate grinding mills forming a primary grinding step and a secondary grinding step which works with material obtained from the primary grinding step. The grinding chamber of the primary grinding step has a first and a second outlet means of which the first outlet means includes a group of openings serving to discharge from said grinding chamber relatively finely ground material which will be wholly or partially ground in the secondary grinding step, while the second outlet means includes a second group of openings serving to discharge from said grinding chamber material also containing relatively coarse pieces forming grinding media in the secondary grinding step. The plant further including means for controlling during the grinding operation the discharge of grinding media containing material from the primary grinding step and means connected between said mills for passing to the secondary grinding step at least all of the material removed from the primary grinding step which has not been ground to the desired final size.

In a plant of the aforementioned kind it is normally desirable to let both mills operate at a preselected power input of their respective driving devices, usually close to the maximum input thereof. This can, however, be difficult to carry out in practice when the grinding mills are coupled in series, since the power consumption of the primary mill is affected by other parameters than those affecting the power consumption of the secondary mill.

The object of the present invention is to provide a novel and useful grinding plant of the aforementioned type which is of simple design and is easy to operate but which, substantially eliminating the aforementioned difficulties at the same time, enables the comminuation of solid materials in an accurately controllable manner while fully utilizing the capacity of the plant.

Accordingly, the plant of the present invention is mainly characterized in that the grinding chamber of the secondary mill is provided with an outlet means including a number of openings with a smallest cross-dimension which is at least substantially equal to the smallest cross-dimension of the openings in said first outlet means of the primary mill, and in that the grinding plant is provided with a classifying means arranged to receive the material from the secondary mill and to separate said material into a finely ground product and an intermediary material requiring further grinding, and with means for continuously returning said intermediary material to the primary and secondary mills in adjustable proportions between the amounts of material returned to the primary and secondary mills.

With this arrangement the advantage is gained that variations in grindability of the starting material fed to the primary mill does not need disadvantageously to affect the composition of the finely ground product separated after the secondary mill, since the means for returning the intermediary material allows selective distribution of the intermediary material to the primary and secondary mill. Thus if the grindability of the ingoing starting material diminishes and/or its coarseness increases, the proportion of the intermediary material received from the secondary mill and returned to the primary mill can be decreased so that a larger portion of the primary mill power is utilized for grinding of incoming starting material. The grinding capacity of the secondary mill available as a consequence of the diminished amount of material from the primary mill is simultaneously utilized for grinding the returned intermediary material. If instead the grindability of the ingoing starting material increases and/or its coarseness diminishes, the proportion of the intermediary material returned to the primary mill can be increased so that the primary mill power and grinding capacity is fully utilized, without the secondary mill, as a result of the increased amount of material from the primary mill, being loaded to such a degree that it gives a product with an undesired particle composition. By making the openings of the outlet means of the secondary mill substantially as large as the openings of the said first outlet means of the primary mill, the collection of material in the secondary mill having a particle size too large to enable it to be effectively ground by means of the grinding media received from the second outlet means of the primary mill is circumvented.

Since the power input required for the secondary mill is essentially independent of the quantity of material passing through said mill, but on the other hand stands in a proportional relationship to the weight of grinding media in it, it is preferred that said means connected between the mills is adapted to pass all the material removed from the primary grinding step directly to the secondary grinding step, the desired power consumption being retained by the means for controlling the discharge of material from the grinding chamber of the primary mill via the said second outlet means being adapted to control said discharge so that the secondary mill will operate with a preselected quantity of grinding media. This can be accomplished in a simple way by controlling the said second outlet means of the primary mill dependently on the power input of the driving device of the secondary mill.

It is further preferred that the classifying means receiving material from the secondary mill includes means for separating the said intermediary material into a coarser and a finer fraction and that the means for returning the intermediary material to the primary and secondary mills is provided with means for primarily returning said coarser fraction to the primary mill. The material of this coarser fraction can namely readily be reduced by the coarse grinding bodies in the primary grinding step and when again discharged to the secondary mill will occur in a particle size more suitable for grinding therein.

The power consumed by the primary mill is, contrary to what is the case in the secondary mill, dependent on the total amount of material in the mill, for which reason the power consumption of the driving device of the primary mill can be held constant by suitable regulation of the material supplied to said mill. In line therewith, it is preferred that said means for returning the intermediary material is adapted to return said intermediary material to the primary and secondary mills in such proportions that the driving device of the primary mill operates with a preselected power consumption.

Separation of the material leaving the secondary mill is suitably effected in a classifying means having a first separating device and a second separating device, the first separating device separating the coarser fraction and the second, which is preferably of the vortex type, separating the finer fraction of the intermediary material from the finely ground material. The first separating device comprises to advantage a classifier of the settling type, for example a spiral classifier, but may also comprise, for example, a screen. The second separating device suitably comprises a hydrocyclone. This arrangement affords the advantage whereby in the first separating device there is obtained a very clearly defined separation of coarse material, while in the second separating device there is obtained a very clearly defined separation of finely ground material.

It also lies within the purview of the invention to pass all the material removed from the primary mill to the secondary mill. This is the case, for example, when the material ground in the plant will be subjected to subsequent flotation or leaching processes. If a more collected particle distribution is required in the ground material, however, it is suitable to provide in said means connected between the mills a classification means for separating material ground to the desired final particle size from the material removed from the primary mill.

Mill drums used in the plant of the present invention are normally internally provided with wear linings, suitably made of a rubber or other elastomeric material. In addition thereto, the mill drums are preferably provided on the heads or end walls thereof and on their cylindrical inner surface with lifters which normally contribute to holding the lining in place. The lifters, which may also be made of a rubber or other elastomeric material, primarily exert a lifting effect to the coarser pieces in the material being ground. This effect produced by the lifters is suitably utilized to homogenize the charge in the mill, by arranging the lifters on the cylindrical surface of the drum so that they extend obliquely relative to the drum axis, the angle formed between the lifters and the drum axis being such that said lifters provide a substantially uniform distribution of said coarser material pieces throughout the length of the drum. This is achieved simply by inclining at least some of the lifters so that, when seen in the direction of rotation of the drum, that portion of the lifters which is located nearest the end wall of the drum is placed further forward than the portion thereof which is further distant from said end wall. Similarly, a conveying effect towards the center region of the drum can be obtained by similarly inclining portions of the front surfaces of the lifters or by giving such portions a helical shape. It is also possible to arrange the lifters along a zig-zag line, so that the material being ground is fed towards a plurality of axially divided regions in the mill. The angles of inclination of the lifters or the front surfaces thereof are chosen in dependence of the diameter of the mill, its length and rotational speed etc., and lie within the range of 2° – 20°. The aforesaid angles of inclination may be different in different portions of the mill, in order that the best possible homogenization of the material charged thereto is obtained. When the drum lining and at all events the lifters are made from a rubber material and the like it is suitable that, when unworn, the lifters have a relatively large height calculated from the cylindrical surface of the drum or the bottom level of the end walls thereof. The height of the lifters is preferably either approximately equal to the diameter or cross-dimension of the largest lumps of material which will conceivably be charged to the mill or, with respect to the inner diameter of the mill, have a height which assumes a value of approximately 4 to 8% of the mill diameter.

Particularly in such cases where a relatively large quantity of grinding media is required for the grinding work effected in the secondary mill, or where the material being ground in the primary mill tends to break down rapidly to sizes falling below those desired for the secondary mill, it is suitable to use in the primary step a mill having a relatively large length-diameter ratio. In a corresponding manner it is also suitable to use in the secondary grinding step a mill having a relatively large length-diameter ratio, to avoid excessive wear on the grinding media and therewith a deficiency of such grinding media in the secondary mill. A suitable length-diameter ratio of the mills is at least 0.7, preferably at least 1.0.

When the apparatus of the present invention is to be used for grinding ore containing in mineral form at least one of the substances gold, copper, lead, molybdenum and uranium, it is especially convenient that the power input of the driving means of the secondary mill comprises less than half, preferably at most one third of the power input to the primary grinding step, since in this way there is obtained finely ground material especially suited for subsequent flotation or leaching processes. In this way ores having a lower content of said substances than in ores now normally processed can be economically recovered.

In accordance with the invention, the means for discharging from the primary mill material containing grinding media can be adjusted during operation. This adjustment can be effected in a number of different ways. In accordance with one embodiment of the invention, the grinding plant includes means for at least partially closing the openings of the second outlet means during operation. This embodiment is particularly useful in connection with mills not provided with a discharge trunnion or mills which employ the periphery discharge technique.

In the case of mills provided with discharge trunnions, it is particularly suitable for the purpose of controlling the removal of material containing grinding media from the primary grinding mill to provide in the discharge end of the primary mill a device which can be adjusted during operation, for selectively directing the material passing through the openings of the second outlet means either back to the discharge portion of the grinding chamber of the primary mill or to said means connected between the mills.

In order that the invention shall be more readily understood and further features thereof made apparent, a grinding plant according to the invention will now be described with reference to the accompanying drawing.

Identical or substantially identical elements are identified in the different Figures by the same reference numerals.

Figure 1:
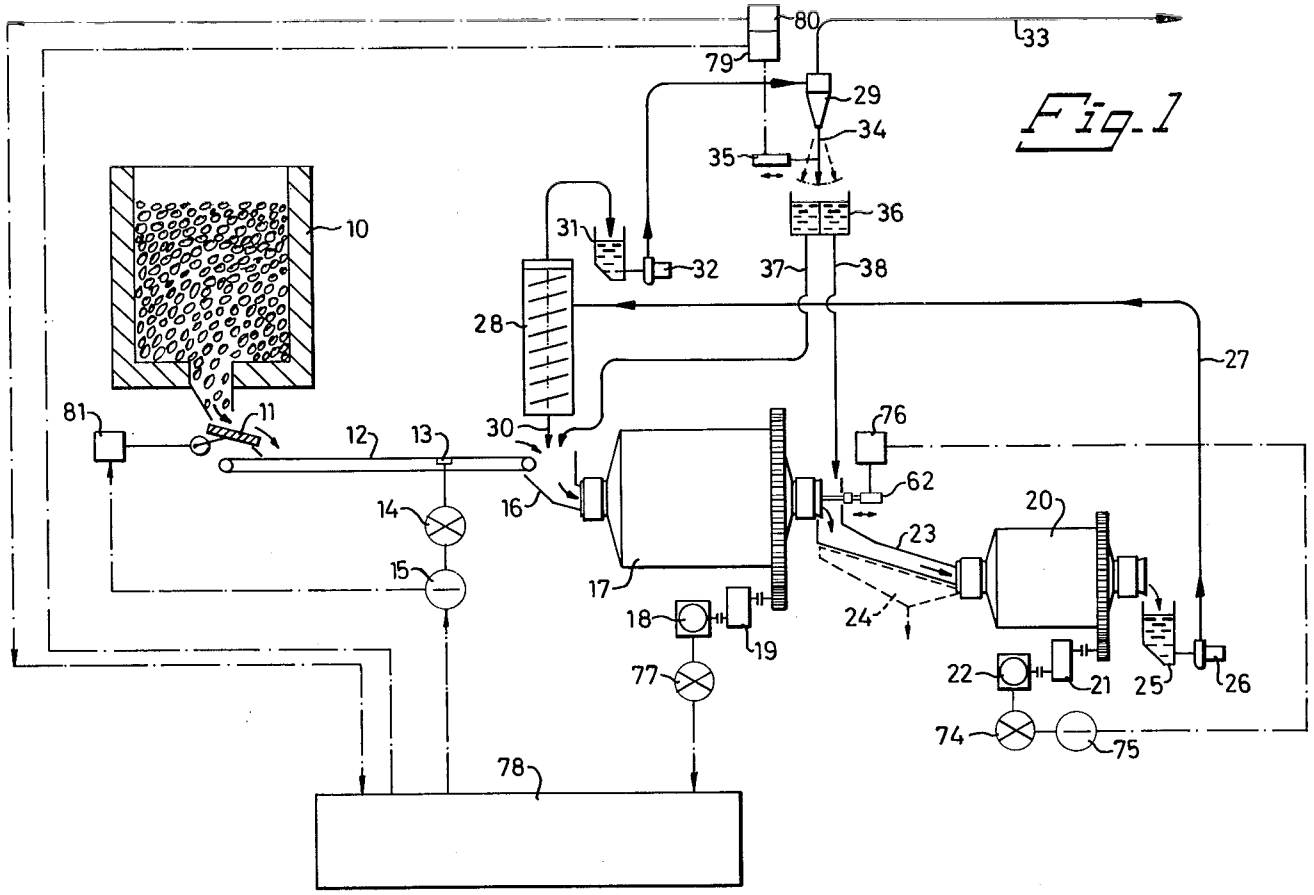
FIG. 1 illustrates diagrammatically a preferred plant according to the invention.

In FIG. 1 the reference numeral 10 indicates a bin from which material to be ground is passed by means of an adjustable feed means 11 to a conveyor 12. The conveyor 12 is provided with a weighing device 13, by means of which the material fed on said conveyor is weighed. The weighing device 13 is coordinated with a flow transmitter 14 which is arranged to transmit any suitable signal such as an electrical signal to a flow control and regulating means 15, that signal corresponding to the flow of material on the conveyor 12. The material is fed to a drum-type primary mill 17 via a chute 16 located at the discharge end of the conveyor 12, the material being autogeneously ground in said mill 17. The mill is driven by an electrical motor 18 via a reduction gear 19.

The mill 17 is provided with means for discharging material which is to be subjected to further autogeneous grinding in a secondary mill 20 and which also contains coarse pieces of material which serve as grinding bodies or grinding media in the secondary grinding step. The secondary mill 20 is driven by an electrical motor 22 via a reduction gear 21. The material discharge means will be described in more detail hereinafter.

A device 23 connected between the mills 17, 20 passes all the primarily ground material discharged from the primary mill 17 to the secondary mill 20. As shown with the dash lines at 24, however, it lies within the scope of the invention to give the device connected between the mills the form of a classifier or screen arranged to separate from the primary ground material such material which is of such small particle size as to render it unnecessary to subject same to further grinding in the secondary mill 20.

It is assumed that the material is ground in the described grinding plant in the presence of water, so that the material departing from the secondary mill 20 is always in the form of a slurry having a pumpable consistency. Water is supplied in a conventional manner, as is known in the art, to the mill 17, 20, to the chutes 16 & 23 or to the vessels 25, 31 and 36 and to the classifier as desired. The material discharged from the secondary mill 20, said material leaving the mill through a conventional discharge grate made of rubber, for example, and arranged at the discharge end of the mill, is passed to a vessel 25, from which it is pumped to a classifying device through a pipe 27 by means of a pump 26, the classifying means comprising a first and a second separating device 28 and 29 respectively. In the separating device 28, which in the illustrated embodiment consists of a spiral classifier, a relatively coarse material is separated, the separated material being passed to the primary mill 17 via the chute 16, as indicated at 30. By adjusting the quantity of water added to the feed box of the screw classifier 28, it is possible to strictly control and regulate the quantity of coarse material separated in the classifier. The quantity of material passed to the primary mill from the spiral classifier 28 is small in relation to the quantity of material arriving from the conveyor 12. The fine fraction obtained from the classifier 28 is passed to a vessel 31, from which it is conveyed by means of a pump 32 to the second separating device 29, which in the illustrated embodiment consists of a hydrocyclone. The material passed to the hydrocyclone contains partly material ground to the desired final size, which is separated and discharged through a pipe 33, and partly a relatively fine but not finely ground material which is passed in a manner hereinafter described to one of the two aforementioned mills or distributed between said mills by a distributing means 34, 35, 36 located at the bottom outlet of the hydrocyclone. This latter material is passed to the mills 17, 20 through pipes 37, 38 which convey the material to the chute 16 and to the device 23 respectively. With the illustrated embodiment, the distributing means 34, 35, 36 consist of a shiftable pipe 34 connected to the bottom outlet of the hydrocyclone, a container 36 divided into two compartments, each of which is connected to its respective one of the pipes 37, 38, and a pressure cylinder 35 connected with the pipe 34 to effect shifting of said pipe so that the material discharged from the pipe 34 can be distributed as desired between the compartments of the container 36 or passed entirely to one or the other of said compartments.

As will be understood, the grinding plant of the present invention can also be designed for dry grinding, wherewith the classifying means 28, 29 are replaced with devices suitable for dry classification operations, for example a dry screen instead of the spiral classifier 28 and a wind sieve instead of the hydrocyclone 29. Similarly, the pumps 25, 26 together with associated equipment are replaced with devices suitable for conveying dry material, for example belt or screw conveyors or pneumatic conveyors.

Figure 3:
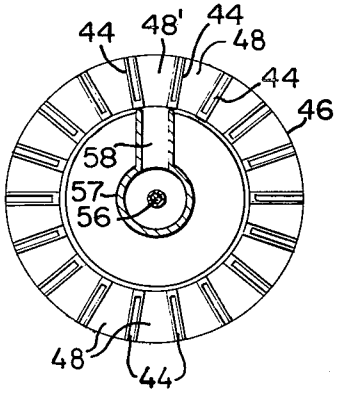
FIG. 3 is a sectional view taken through the line III—III of FIG. 2.
Figure 2:
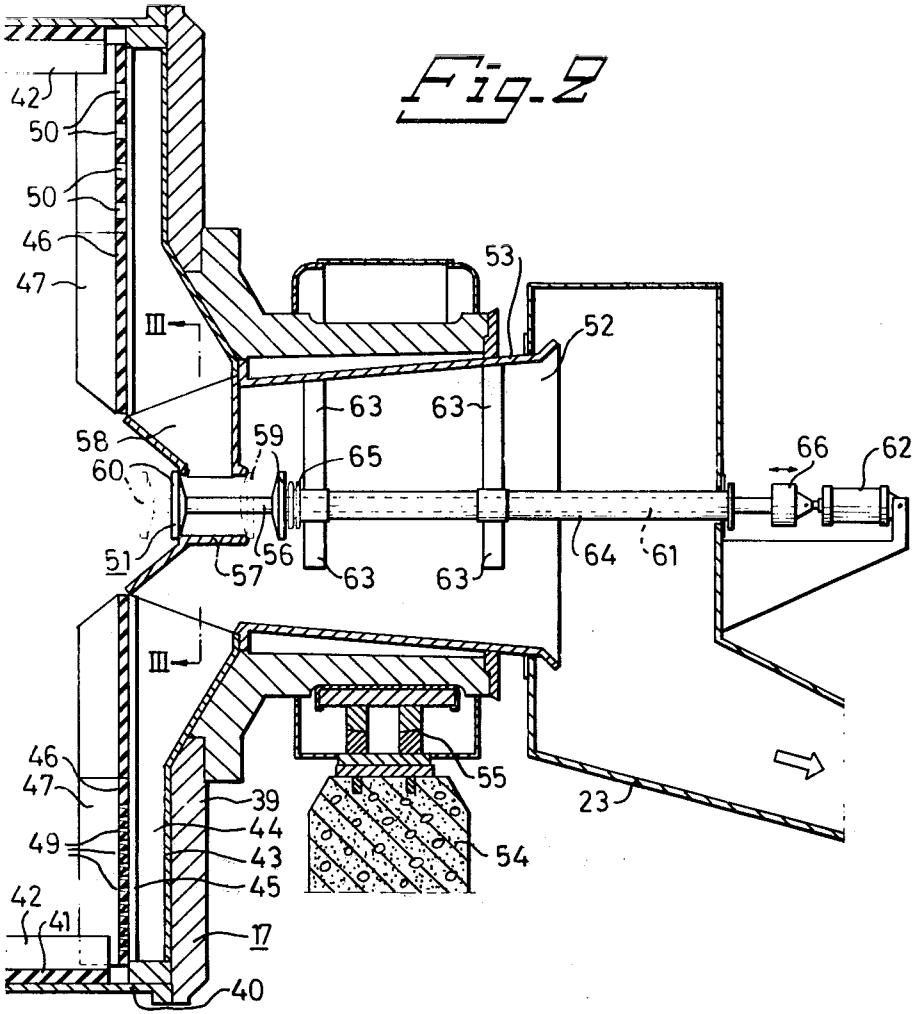
FIG. 2 illustrates diagrammatically an axial sectional view of the discharge portion of the primary mill.

In FIGS. 2 and 3, which show portions of the discharge end of the mill 17, the head or end wall and cylindrical shell or casing of the mill at the discharge end thereof are indicated by the reference numerals 39 and 40 respectively. The cylindrical casing 40 is internally lined with a rubber lining 41 and is provided with a number of lifting bars or lifters 42 which project above said lining and which are also made of rubber. The end wall 39 is also provided with a lining 43, which has a number of sector-shaped plates from which project radially positioned partition plates or webs 44 which have on the edge surface thereof facing the interior of the mill, flange portions 45 which, in turn, carry a rubber inner wall 46. The inner wall is provided with a number of radially positioned lifters 47 and defines, together with the webs 44 and the lining 43 a number of sector-shaped spaces 48, 48'. The inner wall 46 is provided with groups of openings 49 and 50, the first group of openings 49, which connect a number of the spaces 48 with the grinding chamber of the primary mill, serve to discharge relatively finely ground material which is to be further ground in the secondary grinding step. The other group of openings 50, which are relatively large, serves to conduct material containing relatively coarse pieces, which form grinding media in the secondary grinding step, away from the grinding chamber of the primary mill. The openings 50 discharge into the sector-shaped space 48', the portion of which located nearest the mill axis can be arranged to communicate with the outlet opening 52 of the mill trunnion 53 via a valve means generally indicated by the reference numeral 51. The sector-shaped spaces 48 receiving material from the openings 49 discharge directly into the outlet opening 52. The outlet opening 52 passes the material discharged from the grinding chamber of the primary mill directly to the device 23 for further passage to the secondary mill 20. The reference numeral 54 indicates a portion of a support means which carries the mill trunnion 53 via a bearing means 55.

The valve 51 includes a rod-like portion 56 which extends through a cylindrical valve housing 57, said housing communicating with the space 48' via a channel or funnel 58. Mounted on the portion 56 are two valve discs or plates 59, 60, by means of which the one or the other of the end openings of the valve housing can be closed. The valve rod 56 is connected via an extension 61 to the piston rod of a pressure cylinder 62 arranged externally of the primary mill and carried by the device 23. The valve rod 56 can be adjusted by means of the pressure cylinder 62 between the position shown by full lines, in which the valve plate 60 by abutment with the end of the cylindrical valve housing 57 facing the grinding chamber of the mill 17 closes the space 48' against said grinding chamber, and a position shown in chain-dotted lines in which the valve plate 59 closes the axially outer opening of the valve housing 57 and the valve plate 60 is located at a distance from the axial inner opening of the valve housing 57 so that the material charged to the space 48' is able to pass back into the discharge portion of the grinding chamber of the primary mill. In the outlet opening 52 of the mill trunnion 53 are arranged radial supporting means 63 which support a pipe 64 in which the extension 61 is displaceably mounted. The portion of extension 61 located between the valve plate 59 and the inner end of the tube 64 is protected by means of a seal bellow structure 65. Arranged between the outer end of the extension 61 and the piston rod of the cylinder 62 is a coupling 66 which permits rotation of the extension 61 relative to the piston rod. The position of the valve 51 is regulated or adjusted in a manner hereinafter described, so that when the grinding plant is in operation the desired quantity of grinding media is maintained in the secondary mill 20.

Figure 4:
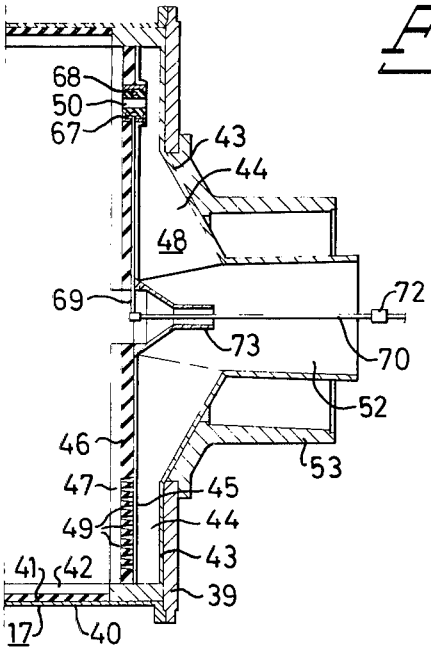
FIG. 4 shows diagrammatically an axial sectional view of an alternative embodiment of the discharge portion of the primary mill.
Figure 5:
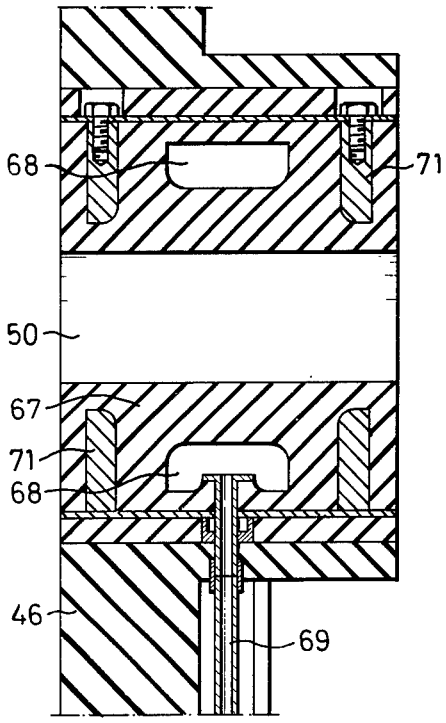
FIG. 5 illustrates in larger scale a portion of the arrangement shown in FIG. 4.

In FIGS. 4 and 5, which show an alternative embodiment of the discharge end of the mill 17, the sector-shaped spaces 48 defined by the inner wall 46, the webs 44 and the lining 43 are all in direct communication with the outlet opening 52 of the mill trunnion 53. The openings 50 for the coarser material containing pieces of such size that they are able to serve as grinding bodies in the secondary mill 20, and the openings 49 for the normal primaryground material, discharge into the spaces 48. The openings 50 can be at least partially closed during the operation of the primary mill 17. Closure of the openings 50 is effected by a device 67 which surrounds each opening 50 and which is capable of being expanded radially inwardly toward the center of the opening. With the illustrated embodiment, the device 67 consists of a sleeve of elastic material attached to the inner wall 46 and having an internal, comparatively wide ring-shaped channel 68. Each ring-shaped channel is connected by means of pipes 69, 70 to a source (not shown) of hydraulic or pneumatic pressure medium by which the sleeve 67 is expanded radially inwardly when pressure is applied in the ring-shaped channel 68. The reference numerals 71 indicate metallic reinforcing inserts for the sleeves, the inserts simultaneously serving to mechanically secure the sleeves. If the pressure medium source is not arranged to rotate together with the mill 17, there is provided a coupling 72 between the pipe 70 and the source of pressure medium, to permit the desired relative rotation. The reference numeral 73 indicates means for protecting the pipes 69, 70 from the material discharged through the openings 49, 50, If the source of pressure medium is mounted on the mill 17 and thus rotates together therewith, the application of pressure to the ring-shaped channels 68, and thus closing and opening of the openings 50, can be controlled by means of tele-signals or radio-signals. In this connection, the opening and closing of the openings 50 is controlled so that the desired quantity of grinding media forming coarse material is constantly maintained in the secondary mill 20.

The grinding plant is provided with control equipment hereinafter described, said equipment ensuring that the inherent grinding capacity of both mills is optimally utilized while obtaining a desired ground product during operation of the grinding plant.

The power delivered by the motor 22 to the secondary mill 20, said power being essentially proportional to the quantity of grinding media as beforementioned, is sensed by means of a power transmitter 74 (FIG. 1) arranged to transmit a signal to a flow control and regulating means 75 responsive to the power sensed. The means 75 is adapted to transmit control signals to a control means 76 when the signal received shows that the power delivered to the mill 20 deviates from a predetermined set point range, normally in the region of maximum power, the control means 76 adjusting the cylinder 62 and therewith the valve means 51 in response to the received control signals. Thus, when the power delivered to the mill 20 reaches the lower limit of the set point range, the valve means 51 (FIGS. 2 and 3) is adjusted to also feed material containing grinding bodies for the secondary grinding step via the outlet opening 52 in the trunnion 53 of the primary mill 17 and the device 23 of the secondary mill 20. Conversely, the supply of material containing grinding bodies is interrupted when the power delivered to the mill 20 reaches the upper limit of the set point range. The same control arrangement can be used when the mill 17 is provided with a discharge means of the type illustrated in FIGS. 4 and 5.

With grinding operations of the type envisaged here, the power required to drive the primary mill 17 is essentially proportional to the quantity of charge in the mill. If the grindability of the material fed to the primary mill 17 from the bin 10 increases or decreases, the charge in the primary mill at a given time will decrease and increase respectively and thus the power required to drive the primary mill will also decrease and increase respectively. Thus, a greater or smaller quantity of material will be fed to the secondary mill 20 than that registered by the weighing device 13, which results in undesirable variations in the screen analysis of the material discharged from the secondary mill. Thus, with regard to the primary mill it is not possible, for the purpose of fully utilizing the capacity of said mill, to control merely the supply of material from the bin 10, but that it must be constantly ensured that the grinding work effected in the grinding plant is so distributed between the mills that the secondary mill delivers material with the desired screen analysis. Thus, if the power consumed in the primary mill 17 drops, the first measure taken in order to increase said power is to increase the quantity of not finely ground material from the cyclone 29 to the primary mill. If necessary, the supply of material from the bin 10 to said primary mill is also increased. If the power increases, the first measure taken is to reduce the supply of material from the cyclone 29 and then, if necessary, to decrease the supply of material from the bin 10. The supply of material from the cyclone and the bin, however, may be reduced in a reversed order to that disclosed, if so desired.

The power consumed by the primary mill 17 is sensed by means of a power transmitter 77, which is arranged to transmit a signal to a logic unit 78 in response to the power sensed. The logic unit 78 is so arranged that if the signal indicates that the power delivered to the mill 17 deviates from a preadjusted set point range the supply of material to the primary mill is adjusted in the aforedescribed manner. The means 35 for directing the flow of material from the cyclone 29 is controlled by a control means 79, which receives control impulses from the logic unit 78 and information regarding its relevant position is transferred to the logic unit by means of a position indicator 80. The logic unit is also arranged so that if the power consumed by the mill does not reach the set point value subsequent to the means 35 being adjusted in response to the signal from the transmitter, so that all material from the cyclone 29 is passed to the mill 17, the flow control and regulating means 15 is arranged to cause a control means 81, which is arranged to be active upon receiving a signal from the means 15, to increase the feed of material via the feed means 11. The supply of material via the feed means 11 is increased until the logic unit obtains, via transmitter 77, information to the effect that a set point value for the power consumed by the primary mill has been reached. When the upper limit of the set point value range is exceeded, the logic unit will ensure that the system is again regulated, by supplying material from the cyclone 29 to the mill 20 and by optionally reducing the flow of material from the bin 10.

The two mills 17, 20 are designed to require mutually different driving power and to rotate at different speeds, depending upon the specific properties of the material to be ground. For example, it is often expedient to design the secondary mill for higher operational rotary speeds than those of the primary mill and to work at a lower power rating than that of the primary mill, for example up to at most half of the power consumed by the primary mill. The openings in the discharged grate of the secondary mill 20 have substantially the same smallest cross dimension as the openings 49 in the discharge grate 46 of the primary mill 17. When grinding ore, which, for example, is to be enriched by flotation techniques, the openings 49 normally have a smallest cross dimension of the order of magnitude of 8–16 mm, for example approximately 12 mm. The openings 50 may suitably have a smallest cross dimension of between 70–100 mm, for example approximately 90 mm.

The grinding plant of the present invention may also be used for semi-autogeneous grinding operations, wherewith grinding bodies comprisng a material different to that of the material being ground are supplied to the primary mill. The number and dimensions of the openings 50 permitting grinding bodies to be passed to the secondary mill 20 are suitably selected, both with autogeneous and semi-autogeneous grinding operations, so that their total through-flow capacity exceeds that required to obtain a sufficient quantity of grinding charge when grinding in the secondary mill while utilizing the full grinding capacity thereof.

The invention is not restricted to the described and illustrated embodiments, but can be modified within the scope of the following claims.

We claim:

1. A grinding plant for autogeneous or semiautogeneous grinding of material in at least two separate grinding mills in a primary grinding step and a secondary grinding step which works with material obtained from the primary grinding step, the grinding chamber of the primary mill having a first and a second outlet means, the first outlet means including a group of openings for discharge from said grinding chamber relatively finely ground material which is to be ground in the secondary mill, the second outlet means having at least one opening to discharge from said grinding chamber material containing relatively coarse pieces to be used as grinding media in the secondary mill; the plant further including means connected between said mills for passing to the secondary mill at least all of the material removed from the primary mill which has not been ground to the desired final size, means for controlling during the grinding operation the discharge of material from the primary mill via the second outlet means so that the secondary mill will operate with a preselected quantity of grinding media, the grinding chamber of the secondary mill having an outlet means including a number of openings with a smallest cross-section which is at least substantially equal to the smallest cross-section of the openings in said first outlet means of the primary mill, and a classifying means arranged to receive the material from the secondary mill and to separate said material into a finely ground product and an intermediary material requiring further grinding, and means for continuously returning said intermediary material to the primary and secondary mills in such adjustable proportions between the amounts of material returned to the primary and secondary mills that the driving means of the primary mill operates with a preselected power consumption.

2. A grinding plant according to claim 1, wherein the power input of the driving means of the secondary mill is less than half of the power input to the primary mill.

3. A grinding mill according to claim 2, wherein the power input of the driving means of the secondary mill is at most one third of the power input to the primary mill.

4. A grinding plant according to claim 1 wherein the classifying means receiving material from the secondary mill includes means for separating said material into a finely ground product and an intermediary material comprising a coarser and a finer fraction, and wherein the means for returning the intermediary material to the primary and secondary mills includes means for primarily returning said coarser fraction to the primary mill.

5. A grinding plant according to claim 4, wherein the classifying means includes a first separating device and a second separating device, the first separating device being arranged to separate the coarser fraction from the material received from the secondary mill and the second separating device being arranged to separate the finer fraction of the intermediary material from the finely ground material.

6. A grinding plant according to claim 1, wherein said means connected between the mills comprise a classification means for separating material ground to the desired final particle size from the material being passed to the secondary mill.

7. A grinding plant according to any of claim 1, wherein at least one of the mills has a length-diameter ratio of at least 0.7, preferably at least 1.0.

8. A grinding plant according to claim 1, comprising means for at least partially closing the openings of said second outlet means when the plant is in operation.

9. A grinding plant according to claim 1, comprising a device arranged in the discharge end of the primary mill capable of being adjusted during operation, for selectively directing the material passing through the openings of said second outlet means either back to the grinding chamber of the primary mill or to said means connected between the mills.

* * * * *